United States Patent [19]

Seidman

[11] 4,368,545

[45] Jan. 18, 1983

[54] FACE PROTECTING DEVICE

[76] Inventor: Elisabeth Seidman, 18988 Carillo Ct., Sonoma, Calif. 95476

[21] Appl. No.: 208,664

[22] Filed: Nov. 20, 1980

[51] Int. Cl.[3] ..... A41D 13/00

[52] U.S. Cl. ..... 2/174

[58] Field of Search ..... 2/174, 171, DIG. 11; 4/519, 521

[56] References Cited

U.S. PATENT DOCUMENTS

| | | | |
|---|---|---|---|
| 2,434,279 | 1/1948 | McDonough et al. | 132/33 R X |
| 2,547,810 | 4/1951 | Burgess | 2/174 X |
| 2,600,392 | 6/1952 | Cancell | 2/174 UX |
| 3,319,262 | 5/1967 | Lee | 2/174 |
| 3,579,656 | 5/1971 | Guarrasi | 4/519 |

*Primary Examiner*—Peter P. Nerbun

*Attorney, Agent, or Firm*—Andrew A. Steiner

[57] ABSTRACT

A device for protecting the face from solutions used is disclosed.

The device comprises a channel shaped flexible body mountable around the head following the hairline. The device is provided with valves for discarding the solution caught in the channel.

1 Claim, 3 Drawing Figures

FACE PROTECTING DEVICE

BACKGROUND OF THE INVENTION

The invention relates to a hair band in general and in special to a band from which the solution is dischargeable during its use, enabling the user to use a drier without removing the band.

DESCRIPTION OF THE PRIOR ART

Numerous face protecting devices are disclosed in the prior art. Some of them are the following: U.S. Pat. Nos. 2,640,198 Mullen, 1,640,676 Shaeffer, 3,529,308 McBride, 2,738,514, Gondell.

The above referenced patents intend to protect the face, eyes, ears during hair treatment; generally they rely on the absorption of the solution by the hair band, however once the band is saturated, the solution will drip down to the face of the user.

The present invention on the other hand has means of discharging the solution caught in the channel.

SUMMARY OF THE INVENTION

Objects and Advantages

It is a principal object of the present invention to provide a device for protecting the face from the solution used during shampooing and hair tinting.

A further object of the present invention is to provide means of discharging the solution which dripped down from the hair.

A further object of the present invention is to enable its user to use a drier without removing the protecting device.

Other objects and advantages will be apparent to those skilled in the art having reference to the accompanying drawings and specifications.

DETAILED DESCRIPTION

Figure 1:
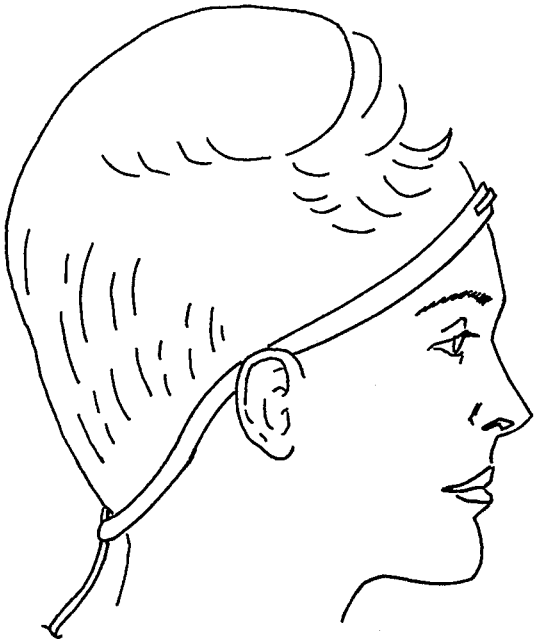
FIG. 1 is a perspective view of the device as used along the hairline.
Figure 2:
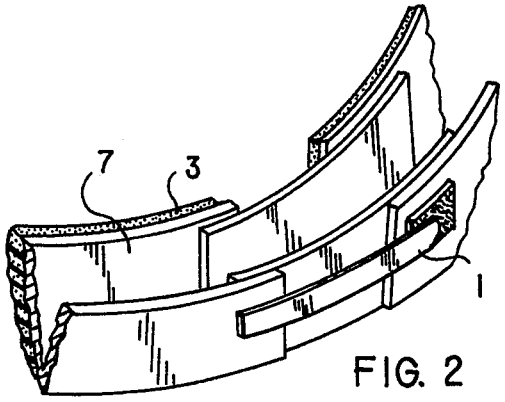
FIG. 2 is a sectional view illustrating the closing of the device.
Figure 3:
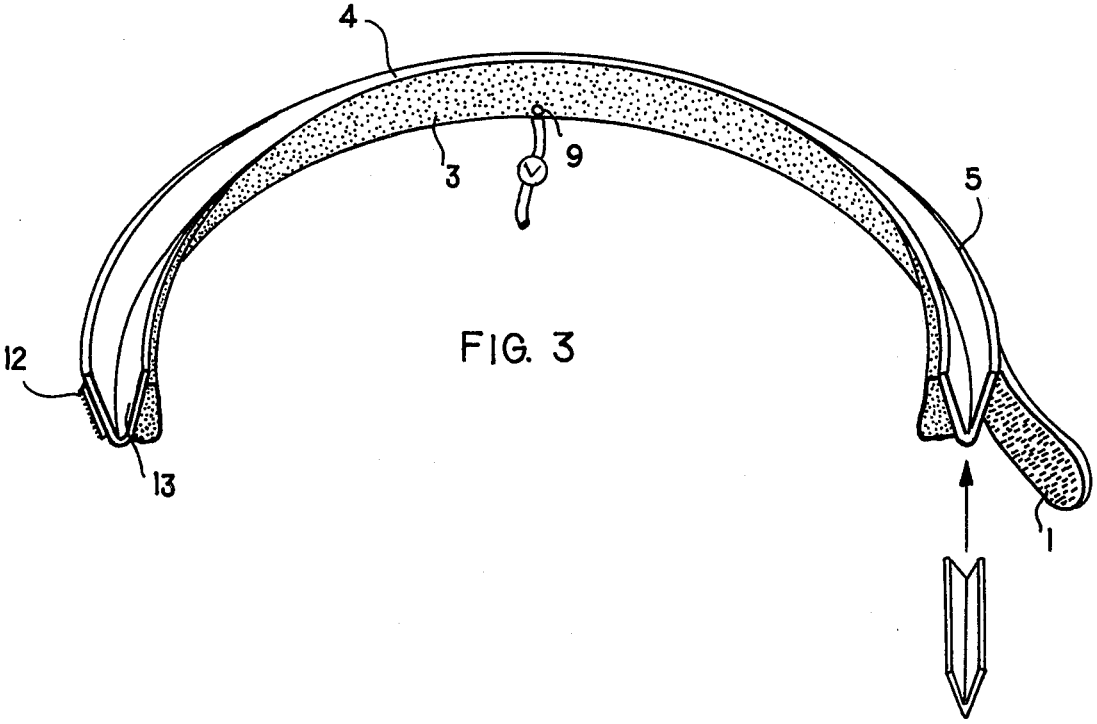
FIG. 3 is a perspective view of the device in open position.

Referring now to the drawing FIG. 3 shows the device comprising a flexible band 4 formed into a channel 7, a soft material preferably a sponge 3 glued or otherwise attached to the wall of the band 4 which will be adjacent to the hairline. At one end the device terminates in a wedge 2, cemented into the channel and adapted to be adjustably inserted into the opposite end of the device.

A flap 1 is attached close to the end of the outside wall 5 of the band 4 and a tab 12 is attached to the other end of the wall 5. The flap 1 is attachable to the tab 12, thereby closing the device.

The band 4 is thick at the center and is tapered toward both ends, making it more suitable for placing it along the hairline. The device is provided with one or more openings, closeable with valves 9, for discharging the solution collected in the channel.

I claim:

1. Apparatus for protecting the face, eyes, and ears of a user against hair permanent solutions comprising:

a flexible, generally upwardly curved band defining a channel, the channel narrow at its outer ends and wider at its center, the band mountable on the head of a user above the eyes and ears of said user, the ban including a soft inner forehead liner;

a flexible strip on one end of the band and a strip receiving tab on the other end of the band;

a removable elongate channel shaped wedge insertable between the ends of the band adjacent the strap and tab;

an optionally closeable solution draining flow rate control valve on the band;

the band wearable by the user during both application of hair permanent solutions and the drying of the hair while the head of the user is in a normal, untilted position, so that the face, eyes, and ears of the user are substantially protected from wetting by the hair permanent solution.

* * * * *